United States Patent [19]

Bonoan

[11] Patent Number: 4,873,964

[45] Date of Patent: Oct. 17, 1989

[54] APPARATUS FOR PLAYING GOLF FROM A GOLF CART

[76] Inventor: Vincent J. Bonoan, 7334 Oak Hill, Houston, Tex. 77087

[21] Appl. No.: 257,689

[22] Filed: Oct. 14, 1988

[51] Int. Cl.[4] ..... A63B 53/00; F41B 7/00

[52] U.S. Cl. ..... 124/20 R; 273/77 R; 280/DIG. 5

[58] Field of Search ..... 280/DIG. 5, DIG. 6; 124/17, 20 R, 20 A, 20 B; 273/77 R, 32 R, 32 B, 32 E

[56] References Cited

U.S. PATENT DOCUMENTS

| | | | |
|---|---|---|---|
| 870,146 | 11/1907 | Webb | 124/20 R |
| 2,577,186 | 12/1951 | Florer | 273/77 R |
| 3,341,202 | 9/1967 | Stars | 273/77 R |
| 3,802,409 | 4/1974 | Mike et al. | 124/20 R |
| 4,363,311 | 12/1982 | Rodney | 273/77 R |
| 4,650,238 | 3/1987 | Henley | 280/DIG. 5 |
| 4,805,583 | 2/1989 | Mosser | 124/17 |

*Primary Examiner*—George J. Marlo

*Attorney, Agent, or Firm*—Pravel, Gambrell, Hewitt, Kimball & Krieger

[57] ABSTRACT

An apparatus adapted for playing golf from a golf cart is disclosed. The apparatus includes a pair of spaced-apart adjustable supporting members attachable to a pair of upright frame members on the front of the golf cart. An elastic sling is attached by its ends to elongated fiberglass members mounted with the supporting members. A pouch secured intermediate the elastic sling allows the player to project the golf ball onto the golf course while the player remains in the golf cart. The player is able to control the force and angle of projection of the ball from the cart.

Advantageously, the apparatus further includes quick release mechanisms on the top ends of the elongated members to allow the removal and replacement of different elastic slings. Additionally, a foldable handle is provided with the apparatus to aid the player in the use and storage of the apparatus.

The apparatus provides a new method of play on a conventional golf course. A method of play is disclosed that allows a handicapped person to participate with those playing a conventional golf game.

19 Claims, 2 Drawing Sheets

FIG. 4
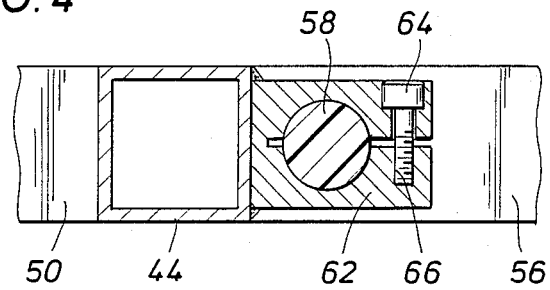
FIG. 7
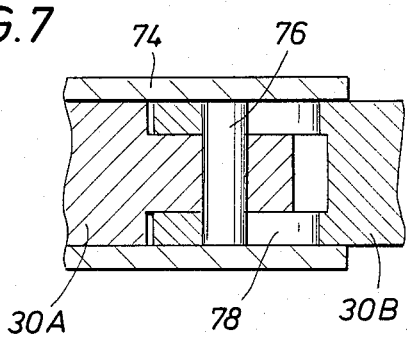
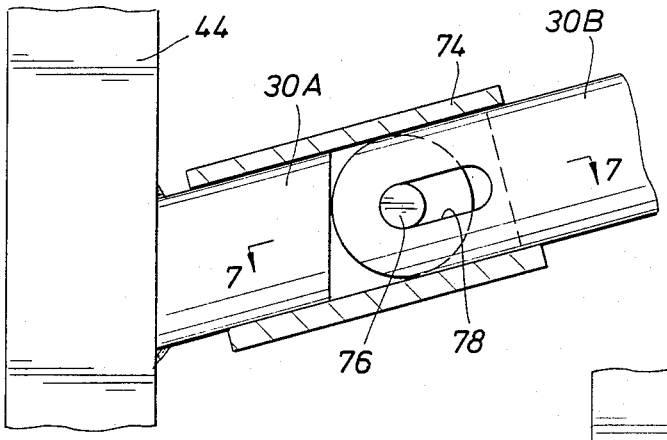
FIG. 5
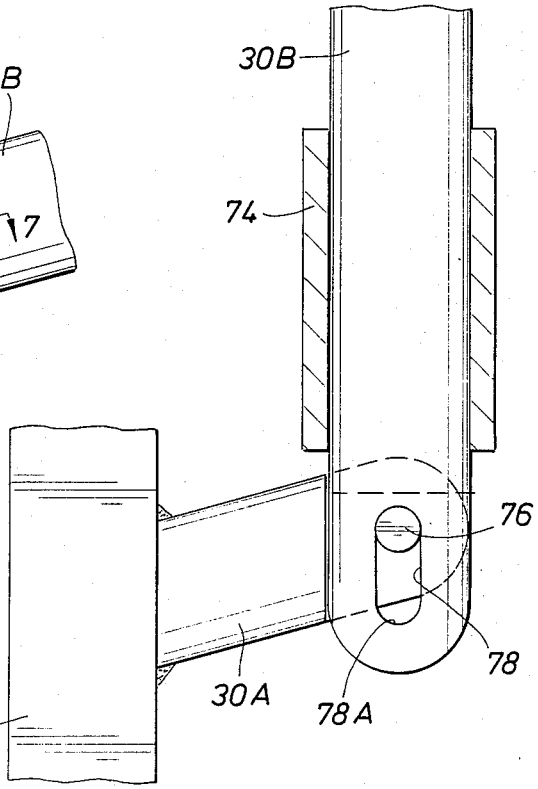
FIG. 6
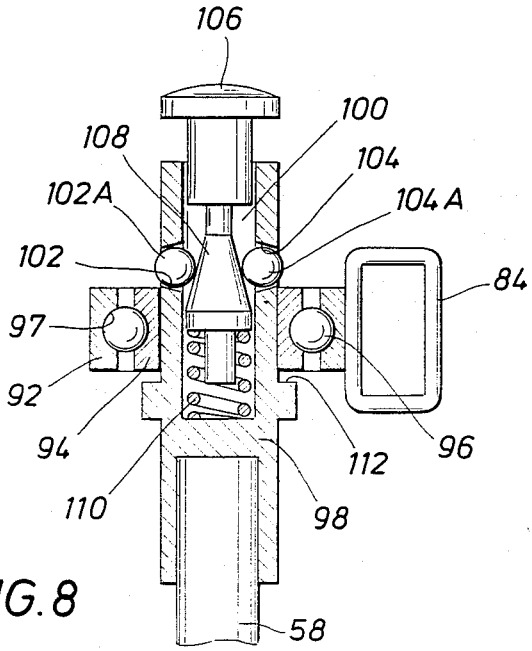
FIG. 8
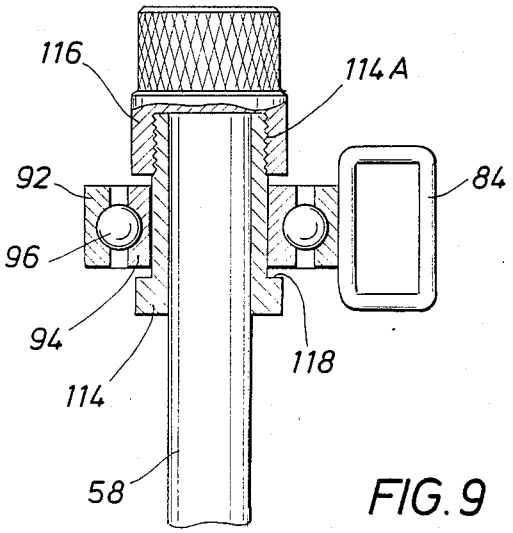
FIG. 9

APPARATUS FOR PLAYING GOLF FROM A GOLF CART

BACKGROUND OF THE INVENTION

1. Field of the Invention

This invention relates generally to an apparatus adapted for playing golf from a golf cart and, more particularly, to an apparatus that adapts a conventional golf cart or the like to provide a method for a player to project and control the movement of a golf ball about a golf course while the player remains in the golf cart. The invention is especially suitable for use by a paraplegic or other handicapped person who could not otherwise enjoy the game of golf.

2. Description of the Prior Art

The game of golf has long been played and enjoyed by golfers. Over the years the great game has been continuously improved with designed golf courses and special equipment. One piece of equipment that has been widely accepted is the golf cart that permits the player to travel through designated areas of the golf course. Therefore, the player need not pull or carry his golf clubs while walking over the course.

In other sports, the barriers preventing handicapped people from participating have slowly been overcome through ingenuity and creativeness in adapting existing facilities for the handicapped. An example of this is the game of handicapped basketball, where through modifications of existing basketball courts a handicapped person, including paraplegics, are able to enjoy a modified form of basketball through the use of specially designed wheeled chairs. Another example is a marathon. Marathon running courses are now open for handicapped individuals such as paraplegics. With the specially designed wheeled chairs these handicapped individuals can participate in the marathon with the regular runners.

But, the game of golf still presents a barrier to people not capable of swinging a golf club and moving about the expansive golf course. There has been an unfulfilled need by people, restricted from the conventional golf game, to enjoy the same relaxing but competitive environment that is offered by the game of golf.

SUMMARY OF THE INVENTION

Briefly, according to the invention an apparatus adapted for use with a golf ball and positioned with a golf cart is provided. The apparatus includes a pair of spaced-apart adjustable supporting members attachable to a pair of upright members on the cart. An elastic sling is attached to a pair of elongated resilient members. A pouch secured intermediate the elastic sling allows the player to project the golf ball onto the golf course while the player remains in the golf cart. The player through developed skills is able to control the force and angle of projection of the ball from the cart in a quest for the optimum score.

Advantageously, the apparatus further includes a quick release mechanism on the top end of each elongated member to allow the replacement of an assortment of elastic slings. Additionally, a foldable handle is provided to aid in the use and storage of the apparatus The apparatus provides a new method of play that permits handicapped individuals to enjoy conventional golf facilities. The disclosed method of play allows a handicapped person to compete in a conventional golf game with regular golfers.

BRIEF DESCRIPTION OF THE DRAWINGS

The objects, advantages and features of the invention will become more apparent by reference to the drawings which are appended hereto and wherein like numerals indicate like parts and wherein an illustrated embodiment of the invention is shown, of which:

FIG. 4 is an enlarged section view taken along lines 4—4 of FIG. 2;

FIG. 5 is an enlarged section view taken along lines 5—5 of FIG. 3;

FIG. 6 is a view similar to FIG. 5 though showing a portion of the handle in a folded position;

FIG. 7 is a section view taken along lines 7—7 of FIG. 5;

FIG. 8 is a quick release mechanism of the present invention; and

FIG. 9 is an alternative embodiment of a quick release mechanism.

DESCRIPTION OF THE PREFERRED EMBODIMENT

Figure 1:
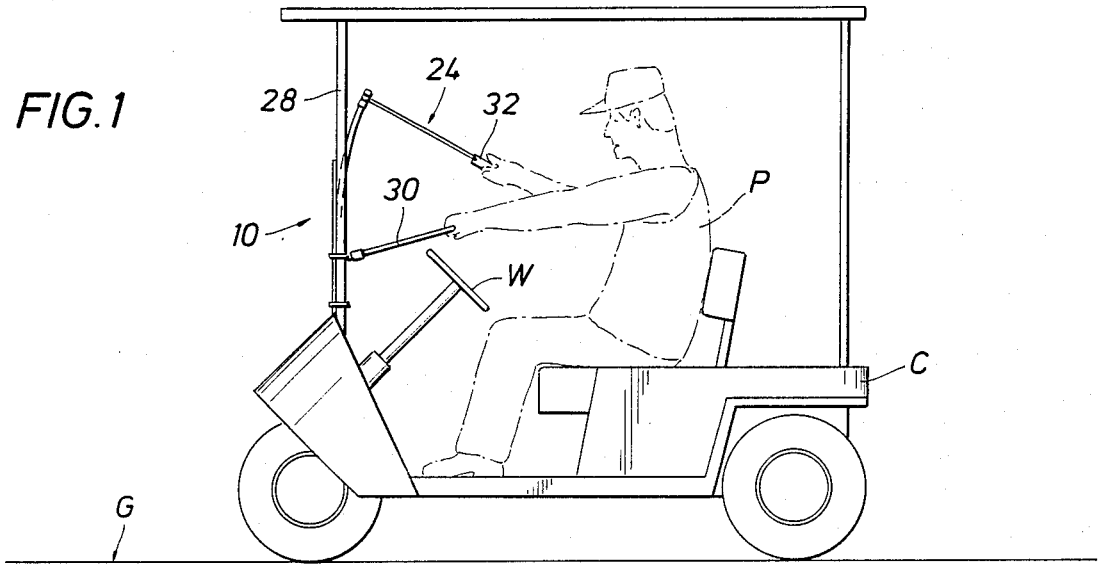
FIG. 1 is a side view of the present invention adapted for use with a golf cart illustrating the apparatus being operated by a player.
Figure 3:
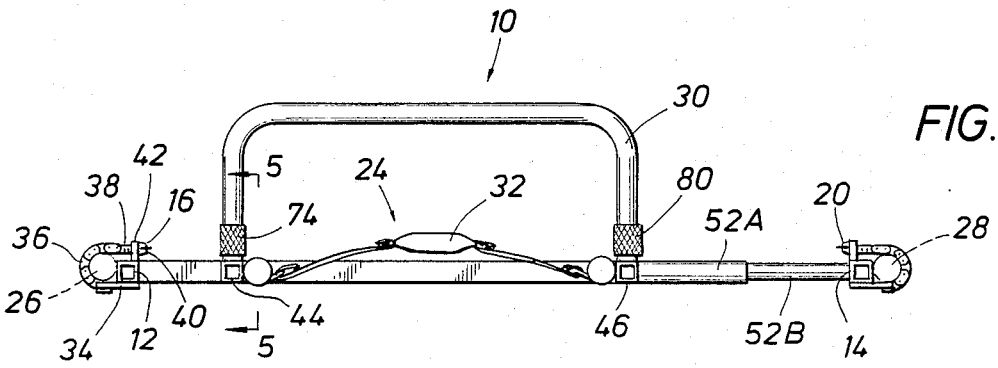
FIG. 3 is a plan view of the present invention as shown in FIG. 2.
Figure 2:
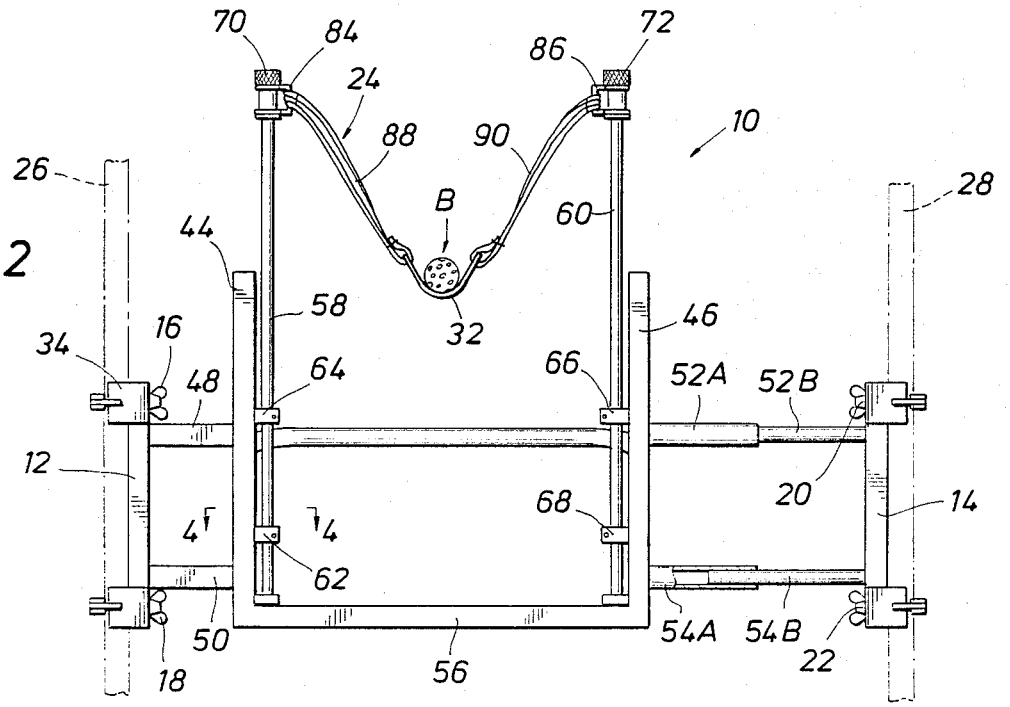
FIG. 2 is a front view of the present invention illustrating its attachment to the golf cart upright members.

The apparatus of the present invention, indicated generally at 10 in FIGS. 1–3, is sized to be installed on a conventional golf cart C. The apparatus includes a pair of spaced apart supporting members 12 and 14, as best shown in FIGS. 2 and 3. The supporting members include four attaching means 16, 18, 20 and 22 for releasably securing the supporting members 12, 14 to the golf cart C. Additionally, an elastic sling 24 controlled by the player P is positioned between the supporting members for moving or projecting the golf ball B from the golf cart C to the golf course G while the player P remains in the cart C.

Though the present invention is shown installed on a golf cart, other types of vehicles such as a converted motorized wheel chair whose configuration could adapt to the present invention is included in its intended use. Therefore, the term "golf cart" as used herein and in the claims is not to be limited to a particular type of vehicle.

Referring now to FIG. 1, the golf cart C includes a pair of spaced-apart upright frame members 26 and 28, as best shown in FIGS. 1, 2 and 3, at the front of the golf cart C. The player P, illustrated in FIG. 1 in a seated position in the golf cart, preferably on the right side, or the opposite side from the steering wheel W, operates the apparatus by grasping handle 30 in one hand and pouch 32 of sling 24 in the other hand.

As best shown in FIGS. 2 and 3, attaching means 16 comprises a plate 34 preferably welded to the front side of supporting member 12. A linked chain 36 is attached between the plate 34 and threaded bolt 38. Bolt 38 is received in a groove in plate 42, as shown in FIG. 3, that is preferably welded to the rear side of supporting member 12. The attaching means 16, representative of all the other attaching means 18, 20 and 22, facilitates the installation or retrofitting of the apparatus to the golf cart C. Though only four attaching means are disclosed, any number could be used to provide a sturdy attachment. Additionally, it is understood that the apparatus could be permanently affixed to a golf cart if desired.

As best shown in FIGS. 2 and 3, a pair of intermediate mounting members 44 and 46 are provided. A pair of spaced-apart lateral members 48 and 50 are positioned between the supporting member 12 and the intermediate member 44. Additionally, a pair of telescoping lateral members 52 and 54 are positioned between the intermediate member 46 and the supporting member 14. As best shown in FIG. 2, the larger diameter lateral members 52A and 54A slidably received about respective members 52B and 54B allows the length of the apparatus to be adjusted for different spacing of the upright members and also aids in the storage and removal of the apparatus. Additionally, lower lateral member 56 is preferably welded between the intermediate members 44 and 46 to provide structural integrity to the apparatus.

Preferably, a pair of elongated upright or vertical rods or members 58 and 60, preferably made of fiberglass or other similar flexible material, are attached to the respective intermediate members 44 and 46 to provide the means for moving or projecting the golf ball B from the golf cart C. The elongated members 58 and 60 provide flexible members that are flexed toward the golfer as shown in FIG. 1 when the golfer pulls on the pouch 32 and the ball B in the pouch. Thus, the rods 44 and 46 contribute to the forward momentum of the golf ball when the player releases the pouch 32 and the ball. When the pouch 32 is released, the rods 58, 60 spring forwardly to assist in projecting the ball, and then because of the nature of the fiberglass or other material, they return to their original upright position.

Turning now to FIG. 4, an enlarged sectional view of the intermediate member 44 and clamp 62 is shown. The clamp 62 includes a threaded bolt 64 received into a threaded shaft 66. Bolt 64 is tightened to properly secure the elongated member 58 in clamp 62. Returning now to FIG. 2, the remaining clamps 64, 66 and 68 are similar to clamp 62 for holding their respective elongated members. Additionally, each elongated member 58 and 60 preferably has a quick release mechanism 70 and 72, which will be discussed below in detail.

Advantageously, the apparatus includes a foldable handle 30, as shown in detail in FIGS. 5, 6 and 7. The foldable handle 30, as shown in FIGS. 5 and 6, includes a first portion 30A attached to intermediate member 44 and a second portion 30B which is movably connected to handle portion 30A. In order to fold the handle 30, sleeve 74 is moved up handle portion 30B allowing portion 30B to rotate about pin 76. Handle portion 30B, as best shown in FIG. 6, is then slid down relative to pin 76 through use of slot 78 to move the handle 30 in the folded position for storage.

By moving the portion 30B of the handle until the slot end 78A is in contact with the pin 76 and then rotating about pin 76 the handle 30 is moved to the aligned operating position, as shown in FIG. 5. Sleeve 74 is then positioned about both the handle portions 30A and 30B to lock the handle 30 in place. In similar fashion the sleeve 80, as shown in FIG. 3, is used to lock the other side of the handle 30.

Another feature of the present invention is the removability of the elastomeric sling member. Generally as indicated in FIG. 2 at 24, a sling is removably mounted on the elongated members 58 and 60 to provide for the selection and use of elastomeric members having different coefficients of elasticity and forces. Two cords, or even a single cord, may be used when it is desired to provide less force than the three cords in FIG. 2 so that the projection of the golf ball for smaller distance shots may be more readily controlled. Rings 84 and 86 are removably attached to the top end of the respective elongated members 58 and 60. Elastic members 88 and 90 preferably made of rubber tubes, secured to rings 84 and 86, respectively, are in turn both attached to leather pouch 32 to receive golf ball B.

Turning now to FIGS. 8 and 9, ring 84 is attached to an outer race 92 which is received about inner race 94. A plurality of ball bearings 96 are received in the torrodial shaped raceway 97 created by the races 92 and 94. These races and ball bearings reduce operating friction of the apparatus which enhances projection of the golf ball. FIG. 8 also discloses a quick release mechanism including a casing 98 having an internal chamber 100 and openings 102 and 104 where balls 102A and 104A are retractably positioned. By pushing the cap 106 downwardly, the frustroconical surface 108 is correspondingly moved to provide an open area to allow the balls 102 and 104 to fall within the chamber 100, out of interference with the interior surface of race 94. Upon release of cap 106, the spring 110 urges the frustroconical member 108 upwardly to its locked position, as shown in FIG. 8, to prevent the inner race 94 from moving past the balls 102A and 104A. Ring 84 is prevented from downward movement by shoulder 112.

An alternative embodiment, shown in FIG. 9, is adapted for use with similar races 92 and 94 having a plurality of balls 96 therein. Casing 114 having a threaded top end 114A onto which a female internally threaded member 116 is screwed prevents the upward movement of the ring 84. Additionally, an upwardly facing shoulder 118 is provided on the casing 114 to prevent downward movement of the ring 84.

USE AND OPERATION

The above apparatus enables a handicapped player, particularly a paraplegic, to enjoy a conventional golf course. The apparatus is first attached to the golf cart C. Then, the golf cart is parked on a designated area in the tee box. The player then places his golf ball B in the pouch 32. Depending on which part of the pouch 32 the player places the ball will control the ball spin produced. For example, if ball B is placed in the player's left-hand side of the pouch, the ball will curve to the right; if the ball is placed in the middle of the pouch the ball will project straight ahead; and if the ball is placed on the right-hand side of the pouch the ball will curve to the left.

As discussed previously, the player P will also be able to control both the distance and the angular projection of each shot. Because of the above control, the player is able to enjoy what is termed course management in the movement of the ball about the golf course.

Once the player has executed the tee shot, his caddy observes golf etiquette and awaits any additional tee shots made by the other players in the group. The player's tee shots with the apparatus have ranged anywhere from 100 to 200 yards in distance depending on the player's strength, type of sling and the flexibility of the elongated fiberglass rods, as well as the type of shot executed. After the tee shot, the caddy preferably reenters the golf cart and proceeds with the player to the next location near the ball. While the caddy and the player are approaching the golf ball on the fairway in preparation of the second shot, the player confers with his caddy and verbally directs the angle and approach of the cart ideal for the second shot. The golf cart should be positioned so that it does not surpass the golf ball. Once the position of the cart is approved by the player, the caddy setting the brake on the golf cart, steps out to hand the golf ball to the player.

The player then preferably executes his second shot with the caddy out of the golf cart, as best shown in FIG. 1. The sling is preferably positioned to allow the player to propel the golf ball from the passenger seat. If desired the player can slide from the passenger's seat to the driver's seat or vice versa to execute any shot. When the golf ball finally lands on the green, the distance of the ball from the hole is determined and that is used for scoring purposes since the handicapped person cannot putt on the green. After the ball is on the green, play is terminated on that hole for that player.

When the golf cart cannot be positioned for a particular shot without damaging the golf course, the shot will be considered unplayable and will cost the player a one shot penalty. The player is allowed to take his next shot from the nearest relief, no closer to the pin. There is also a one shot penalty if the ball enters any sand trap or water. Again, the next shot will be taken from the nearest relief, no closer to the pin.

The skilled player, sophisticated in the play of the game, will determine a course management to maximize his score by avoiding hazards such as sand traps, water or rough areas and negotiating turns in the fairway of the course.

Unlike wheel chair basketball, this above method has a designated handicap system that will allow the player to be flighted so that he can participate and compete in conventional golf games. Moreover, the above game preferably has a scoring system as discussed below, that is compatible to all conventional golf score cards. Below are examples of scoring for a par 3, par 4 and par 5 holes that better illustrate the scoring method used in this game.

PAR 3 HOLE

A hole in one on the first shot counts as one shot or an Ace. If the first shot is on the green, it is scored as a Par; but if the ball lands within a pin length from the hole, it is scored as a Birdie. If the green is missed on the first shot, the second shot to the green must be within the pin's length of the hole to par. If the ball is holed on second shot, then it is scored as a Birdie. If the ball on the second shot is outside of the pin distance, it is scored as a Bogey.

PAR 4 HOLE

In a 400 yard Par 4 hole, the first shot is projected down the fairway approximately 100 to 200 yards. If the second shot lies (a) anywhere on the green, the score is a Birdie, or (b) if the ball is within a pin length on the second shot, the score is an Eagle. If the ball is short of the green on the second shot, the player must shoot a third shot. If the ball is anywhere on the green on the third shot, the score is a Par; but if the ball is within a pin length, the score is a Birdie.

If the ball is anywhere on the green on the fourth shot, the score is a Bogey; but if the ball goes in the hole on the fourth shot, the score is a Birdie. If the ball lands on the green on the fifth shot the score is a Double Bogey. All Bogey shots to the green are minus two (−2) shots back to the Birdie score if the ball goes in the hole.

PAR 5 HOLE

If the ball comes to rest anywhere on the green in two shots, it is scored as an Eagle. If on the green in two shots and within a pin length of the hole, it is scored as a Double Eagle. If the ball is on the green anywhere in three shots, it is a Birdie. If on the green in three shots and within a pin length of the hole, it is also an Eagle. If the ball is on the green in four shots anywhere, the score is a Par. If the ball rests within a pin length of the hole, the score is a Birdie on the fourth shot.

If the ball is on the green in five shots, the score is a Bogey. If the ball is on the green in five shots and within the pin length, the score is a Par. If the ball goes in the hole in five shots, the score is a Birdie. All Bogey shots to the green are minus two (−2) shots. If the ball goes in the hole, then the score is a Birdie.

The foregoing disclosure and description of the invention are illustrative and explanatory thereof, and various changes in the size, shape and materials, as well as in the details of the illustrated construction may be made without departing from the spirit of the invention.

I claim:

1. Apparatus adapted for playing golf from a golf cart used for moving a player about a golf course and wherein a golf ball is projected from the golf cart, the apparatus comprising:

projecting means controlled by the player for moving the golf ball from the golf cart to the golf course while the player remains in the golf cart; and laterally disposed attachment means spaced apart on opposite sides of said projecting means for attaching said projecting means to spaced apart members on the golf cart.

2. The apparatus of claim 1 further comprising:

a pair of spaced apart supporting members attachable to said golf cart, said projecting means positioned between said spaced apart supporting members.

3. The apparatus of claim 2 wherein the front end of the golf cart includes a pair of spaced apart upright members, and said attachment means is adapted to be removably attached to said spaced apart golf cart upright members.

4. The apparatus of claim 2 further comprising:

mounting means for mounting said projecting means with said supporting members.

5. The apparatus of claim 4 wherein said mounting means is adjustable to adapt to a plurality of spaced apart upright members.

6. The apparatus of claim 2 wherein said projecting means comprises:

a pair of elongated resilient members secured to said supporting members.

7. The apparatus of claim 6 wherein said projecting means further includes an elastomeric member being fastened at one of its ends to one of the elongated members and the other end of the elastomeric member being fastened to the other elongated member.

8. The apparatus of claim 7 further comprising a pouch secured intermediate said elastomeric member, said pouch movable between a relaxed position and an extended position for moving the golf ball with a plurality of forces and angular projections from the golf cart.

9. The apparatus of claim 7 wherein the elastomeric member being replaceable to allow a range of forces.

10. The apparatus of claim 7 wherein the top end of said elongated members having a quick release means to aid in replacement of the elastomeric member.

11. The apparatus of claim 6 further comprising
an elastomeric member, and
means removably interengaged between said elongated members and said elastomeric member for reducing friction.

12. The apparatus of claim 11 wherein said means for reducing friction includes ball bearings disposed between an inner race and an outer race.

13. The apparatus of claim 6 wherein the top ends of the elongated members being weighted to operably aide in projecting the golf ball.

14. The apparatus of claim 1 further comprising a foldable handle.

15. Apparatus adapted for playing golf from a golf cart used for moving a player about a golf course and wherein a golf ball is projected from the golf cart, the apparatus comprising:
a pair of spaced apart elongated members laterally disposed attachment means spaced apart on opposite sides of said elongated members for attaching said spaced apart elongated members to spaced apart members on the golf cart, and
elastic means controlled by the player and disposed between said spaced apart elongated members for projecting a golf ball from the golf cart to the golf course while the player remains in the golf cart.

16. The apparatus of claim 15, wherein the front end of the golf cart includes a pair of spaced apart frame members, and
said attachment means removably attach said spaced apart elongated members to said frame members on the golf cart.

17. The apparatus of claim 16, wherein the attachment means includes:
a support frame having a pair of spaced apart support members.

18. The apparatus of claim 17, wherein said attachment means is adjustable to adapt to spaced apart frame members with different spacings from each other.

19. The apparatus of claim 15, wherein said elongated members are flexible so as to flex when a sufficient force is applied thereto by pulling on said elastic means to thereby assist the elastic means in projecting the golf ball.

* * * * *